United States Patent [19]

Pradier et al.

[11] Patent Number: 4,553,292

[45] Date of Patent: Nov. 19, 1985

[54] RAPID ATTACHMENT DEVICE FOR SKI BOOTS

[75] Inventors: Serge Pradier, Alby-sur-Cheran; Jean-Louis de Marchi, Duingt, both of France

[73] Assignee: Etablissements Francois Salomon et Fils, Annecy, France

[21] Appl. No.: 589,361

[22] Filed: Mar. 14, 1984

[30] Foreign Application Priority Data

Mar. 30, 1983 [FR] France ..... 83 05212

[51] Int. Cl.[4] ..... A43B 5/04

[52] U.S. Cl. ..... 24/70 SK; 24/68 SK; 24/71 SK

[58] Field of Search ..... 24/68 SK, 68 B, 69 SK, 24/70 SK, 71 SK, 498, 637

[56] References Cited

U.S. PATENT DOCUMENTS

| | | | |
|---|---|---|---|
| 3,258,820 | 7/1966 | Steinberg | 24/70 SK |
| 3,363,288 | 1/1968 | Lange et al. | 24/68 SK |
| 3,562,872 | 2/1971 | Haubensack | 24/70 SK |
| 4,470,175 | 9/1984 | Chiarella | 24/70 SK |

FOREIGN PATENT DOCUMENTS

| | | | |
|---|---|---|---|
| 1356463 | 2/1964 | France | 24/70 SK |
| 84037 | 10/1964 | France | 24/70 SK |
| 1393137 | 2/1965 | France | 24/70 SK |
| 694728 | 9/1965 | Italy | 24/70 SK |

*Primary Examiner*—Victor N. Sakran

*Attorney, Agent, or Firm*—Pollock, Vande Sande & Priddy

[57] ABSTRACT

Adjustable toggle type attachment device for a ski boot, with a series of notches constituting a rack fixed to an element to be tightened, and a tightening lever connected through a traction element to another element to be tightened. An abutment longitudinally adjustable in a continuous manner is provided on the lever, and the traction element is supported thereon.

6 Claims, 4 Drawing Figures

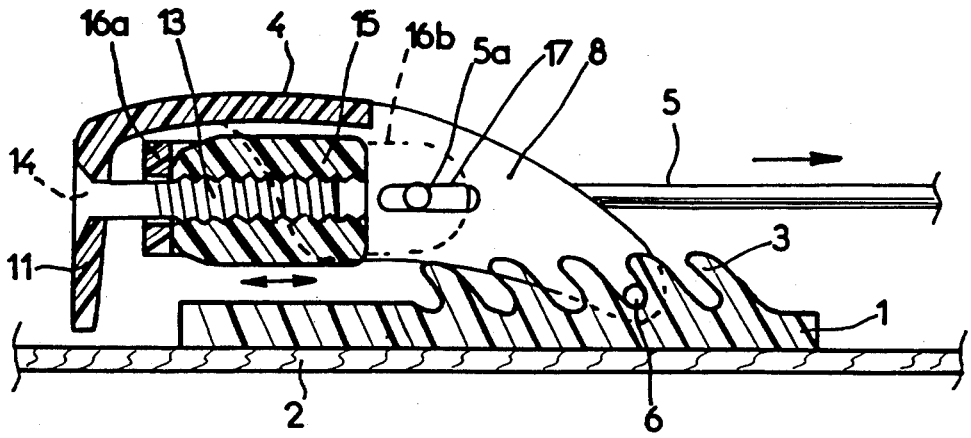

RAPID ATTACHMENT DEVICE FOR SKI BOOTS

SUMMARY OF THE INVENTION

The present invention relates to a rapid attachment device of the toggle type for ski boots, with adjustable tightening force.

BACKGROUND OF THE INVENTION

Ski boots are generally provided with a rapid attachment device of the toggle type, comprising on the one hand, a rack with several notches attached to one of the elements to be tightened, and on the other hand a tightening lever connected, through a traction element, to the other element to be tightened. At one of its ends, the lever carries a hooking finger to be lodged in one of the notches of the rack, depending on the desired degree of tightening. Such a device enables the tension of the tightening element to be varied, i.e., the level of tension can be altered at the user's discretion.

It is known, e.g., from French Patent No. 1,538,725, to provide means enabling continuous adjustment of the tension of a traction element on ski boots. Such means normally comprise a screw-nut assembly interposed between a hooking buckle and the traction element, the buckle being engaged with one of the notches of a rack provided on the tightening lever. However, such a device has the drawback that all of its constituent elements are visible, thus detracting from the appearance of the assembly, and their operation can be altered as a result of the penetration of snow or other foreign bodies.

OBJECT OF THE INVENTION

The present invention is intended to overcome these drawbacks by means of a particularly simple construction comprising entirely concealed and protected means for continuously adjusting the tightening force.

To this end, the rapid attachment device of the toggle type, with adjustable tightening force, particularly for a ski boot, comprising a succession of notches constituting a rack fixed to one of the elements to be tightened and a tightening lever connected, through a traction element, to the other element to be tightened, the tightening lever carrying a hooking finger to be engaged in one of the notches of the rack, according to the desired degree of tightness, and constituting an articulation axes of the tightening lever, is characterized in that it comprises, on the tightening lever, an abutment the position of which is horizontally adjustable in a continuous manner, and on which the traction element is supported.

The traction element may be supported on the adjustable abutment either directly, or, preferably, through the intermediary of a connecting piece mounted for longitudinal sliding movement on the lever.

The adjustable abutment is preferably constituted by a sleeve screwed on a threaded longitudinal rod solid with the forward wall of the lever.

The rapid attachment device according to the invention provides the advantage that all of its elements are concealed and protected under the tightening lever when the latter lies flat in closure position, and that the adjustable abutment is very easily accessible when the tightening lever is open, for adjustment of the tightening force.

BRIEF INTRODUCTION TO THE DRAWINGS

In order that the invention may be more clearly understood, reference will now be made to the accompanying drawings, in which an embodiment of the invention is shown for purposes of illustration, and in which FIG. 1 is a longitudinal section view of the inventive device in closed position, i.e., with the tightening lever flat on the rack.

FIG. 2 is an elevation view of the tightening lever.

FIG. 3 is a section view along line III—III of FIG. 2.

FIG. 4 is a bottom view of the tightening lever.

DESCRIPTION OF PREFERRED EMBODIMENT

The rapid attachment device shown in FIGS. 1 to 4 comprises a rack 1 attached to an element 2, such as a wall of a ski boot, which is to be assembled with and tightened against another element (not shown). On its outer face, rack 1 has a succession of notches 3. The device also comprises a tightening lever 4 which is connected to a traction element 5, flexible or rigid, which is attached at its end to the other element to be assembled with and tightened against element 2.

At one of its ends, tightening lever 4 comprises a transverse hooking finger 6, for lodging in one of notches 3, according to the desired degree of tightness.

Tightening lever 4 is preferably constituted of a single piece of molded plastic with a slightly curved upper wall 7, concave toward the bottom, i.e., toward rack 1 in its closed position. Upper wall 7 is extended toward the bottom by two longitudinal and vertical wings 8 and 9, as well as front wall 11 located opposite hooking finger 6. This hooking finger extends between the extreme right portions of the two vertical wings 8, 9 to which it is fixed. As open space 12 is defined between front wall 11 of lever 4 and the facing left ends of the two vertical wings 8, 9.

The means enabling continuous adjustment of the tightening force comprise a threaded rod 13 which extends longitudinally in open space 12, and which is slightly engaged between the extreme left facing portions of the two vertical wings 8, 9. Rod 13 terminates in a widened head 14 which is lodged and attached in a corresponding hole provided in front wall 11. A sleeve 15 is screwed on rod 13, constituting an adjustable abutment. The lateral surface of this sleeve 15 is preferably irregular, in order to facilitate its rotative entrainment. This surface may, for example, be provided with longitudinal grooves, or be knurled or fluted.

The cross-piece **16*a* of a yoke-shaped connecting member 16 extends into open space 12 between sleeve 15 and front wall 11. This cross-piece is pierced, in its central portion, by a hole traversed by threaded rod 13, and is extended in the direction of hooking finger 6 by two lateral wings 16*b*, 16*c* which embrace between them the vertical wings 8, 9 of lever 4. The end portions of wings 16*b*, 16*c* are pierced by holes which are traversed by a transverse portion 5*a* of traction element 5 which is thus connected to yoke 16. Portion 5*a* also traverses longitudinal apertures 17, 18 provided opposite one another in the respective vertical wings 8, 9**.

It will be understood from the preceding description that, when the rapid attachment device is closed, traction element 5 pulls on yoke-shaped connecting member 16 and forces the latter against the opposite front face of sleeve 15, which constitutes the adjustable abutment. As a result, when lever 4 is in open position, turning sleeve 15 to a greater or lesser extent enables longitudinal displacement of the position of the front abutment position of the sleeve, and hence corresponding adjustment of the tension of traction element 5, in tightening position.

As can be seen in FIGS. 1 and 2, all the constituent parts of the means for adjusting the tightening force are concealed under lever 4 when the latter is in closed position.

As a variant, traction element 5 could be provided directly on a longitudinally adjustable abutment similar to sleeve 15.

What is claimed is:

1. Rapid attachment device for a ski boot, of the toggle type, with adjustable tightening force, comprising a series of notches (3) constituting a rack (1) fixed to an element to be tightened, and a tightening lever (4) permanently connected by a traction element (5) to a second element to be tightened, said lever comprising a hooking finger (6) for engaging one of said series of notches, depending on the desired degree of tightness, and constituting an articulation axis of said lever, said lever having an element (15) thereon the position of which is longitudinally adjustable in a continuous manner while said hooking finger (6) remains in engagement with a notch of said rack, and on which said traction element (5) is supported.

2. Device according to claim 1, wherein said adjustable abutment comprises a sleeve (15) screwed onto a longitudinally threaded rod (13) solid with a front wall of said lever (4).

3. Device according to claim 2, wherein said traction element (5) is supported directly on said adjustable abutment (15).

4. Device according to claim 2, wherein said traction element (5) is supported on said adjustable element (15) through the intermediary of a connecting member (16) mounted for longitudinal sliding movement on said lever (4).

5. Device according to claim 4, wherein said connecting member (16) comprises a yoke having a cross-piece (16*a*) pierced by a hole traversed by said threaded rod (13) extended in the direction of said hooking finger (6) by two lateral wings (16*b*, 16*c*) traversed by a transverse portion (5*a*) of said traction element (5).

6. Device according to claim 5, wherein said two lateral wings (16*b*, 16*c*) of said connecting member (16) enclose between them two longitudinal vertical wings (8, 9) of said lever (4), and are pierced by longitudinal apertures (17, 18) provided opposite one another and traversed by said transverse portion (5*a*) of said traction element (5).

* * * * *